US005660124A

United States Patent [19]

Doncer

[11] Patent Number: 5,660,124

[45] Date of Patent: Aug. 26, 1997

[54] SLUDGE PROCESSOR

[75] Inventor: Alex J. Doncer, Palos Heights, Ill.

[73] Assignee: Alar Engineering Corporation, Mokena, Ill.

[21] Appl. No.: 530,898

[22] Filed: Sep. 20, 1995

[51] Int. Cl.[6] ..... D06F 75/00

[52] U.S. Cl. ..... 110/227; 110/229; 110/258

[58] Field of Search ..... 110/227, 229, 110/258, 293

[56] References Cited

U.S. PATENT DOCUMENTS

| | | | |
|---|---|---|---|
| 2,279,848 | 4/1942 | Unger, Jr. . | |
| 3,744,145 | 7/1973 | Maxwell et al. . | |
| 3,808,701 | 5/1974 | Bachmann . | |
| 4,276,701 | 7/1981 | Takacs et al. . | |
| 4,532,872 | 8/1985 | Andersson | 110/293 |
| 4,726,301 | 2/1988 | Des Ormeaux et al. | 110/227 |
| 5,020,452 | 6/1991 | Rybak | 110/258 |
| 5,263,267 | 11/1993 | Buttner et al. . | |
| 5,271,163 | 12/1993 | Pikus et al. . | |

FOREIGN PATENT DOCUMENTS

| | | | |
|---|---|---|---|
| 63-20132A | 11/1994 | Japan | 110/258 |
| 61385 | 3/1923 | Sweden . | |

*Primary Examiner*—John T. Kwon

*Attorney, Agent, or Firm*—Hill, Steadman and Simpson

[57] ABSTRACT

An apparatus for drying and heating sludge to remove pathogens and to dry the sludge into a powder form which includes an elongate housing having an endless chain conveyor inside. The conveyor having outwardly extending scrapers for slowly urging solid material from one end of the housing to the other. The housing is heated to heat the sludge and a fan removes moisture laden air from within the housing. The scrapers are provided in rows and include specialized scrapers including plows, inclined paddles, and round rods to sequentially split, redirect, split, and redirect again the stream of sludge being urged through the housing. By so mixing the stream of sludge, cold and hot spots are avoided during heating and a build up of sludge on a floor of the housing is avoided.

10 Claims, 3 Drawing Sheets

SLUDGE PROCESSOR

BACKGROUND OF THE INVENTION

The present invention relates to an apparatus and method for treating solids in a waste disposal system, particularly in order to dry and to treat sludge from a waste treatment facility.

Sludge from a waste treatment facility is typically wet including the possibility of contamination with pathogens, hazardous materials, or undesirable materials. It is important in the treatment of sludge that water be removed and pathogens or contaminates be killed in the sludge so that the sludge can be transported, disposed of more easily such as in a landfill, incinerated, or reused as fertilizer or fill. Wet sludge or waste material having a significant liquid portion or having pathogens or other contaminates, is more difficult to transport and dispose in a landfill because of its added weight, and its propensity to migrate in the soil when the liquid portion is an undesirable or hazardous waste. A dried and stabilized solid material consisting of a powder-like material would be desirable for transportation, disposal, incineration or recycling. An apparatus and method for drying and treating sludge would be advantageous.

SUMMARY OF THE INVENTION

It is an object of the present invention to provide an apparatus and method for drying and treating sludge to form a dry powder-like material, more easily transported, disposed, incinerated or recycled. It is an object of the invention to provide an apparatus which is reliable and resists breakdowns and blockages in the handling of the solids to be dried and treated. It is an object of the present invention to provide an apparatus and method which dries, sterilizes, and processes the sludge into a powder.

It is an object of the invention to provide a sludge processing apparatus which provides a long maintenance-free run time between cleaning, is energy efficient, and effective. It is an object of the present invention to provide a sludge processor which thoroughly heat sterilizes sludge material without creating cold and warm regions in the sludge which can cause recontamination from pathogens not killed or contaminants not removed.

The object is inventively achieved in that a sludge processing apparatus is provided having an elongated, heated flat bottom conduit with an endless conveyor therein. Partially dewatered sludge from an upstream filter is supplied to an inlet of the conduit, through an air trap to a clod breaker. The clod breaker acts to break up any solid clods contained within the sludge. After passing through the clod breaker, the sludge is deposited on the bottom of the conduit. A conveyor chain is positioned above the bottom of the conduit and uses a pair or more of parallel endless chains having longitudinally spaced apart transverse ribs mounted between the chains. The ribs have depending therefrom, mixing and moving members which come into engagement with the sludge under the chain and agitate the sludge while moving the sludge along the length of the heated conduit toward an exit.

The conduit may have two or more heating zones one of which may be heated to a temperature of 400° to kill all pathogens in the sludge. A blower is provided for extracting moisture laden air from the conduit. As part of the invention, the sludge contacting members depending from the chains have a different geometry from row to row. One row may consist of paddles, angled in one direction, whereas the next row may consist of paddles angled in the opposite direction.

Straight rods lining up with the intersections between the paddles break up the mound left by the moving paddles. Additional structures include plows and/or other shapes. The sludge solids are constantly moved side-to-side and back again while breaking up the mounds left by movement of the paddles and plows with the rods. Thus, the sludge is constantly agitated, mixed and remixed as it is at the same time being moved along the length of the conduit.

Because the various paddles and plows are allowed to scrape along the bottom of the conduit, no sludge cake build up occurs that would result in an insulating layer and heat transfer loss. Movement of the conveyor is variable and, in general, exceeds the movement speed of the sludge by a factor determined by the angulation of the paddles and the like. The paddles are angularly adjustable in their mounts. In one particular embodiment, the conveyor might move at the rate of 2–3 feet per minute while the sludge, moving slower, can have a total throughput of about 200–400 pounds per hour for a 35% solids content at the inlet, to a substantially dry, powder-like consistency at the outlet. Other embodiments can be provided having different throughputs, some larger and some smaller than 200–400 pounds per hour. Also, the percentage of solids content can vary from 35%. An air trap can be provided at the outlet.

To make for an energy efficient apparatus and process, the entire conduit is insulated to conserve against heat loss.

DETAILED DESCRIPTION OF THE PREFERRED EMBODIMENTS

Figure 1:
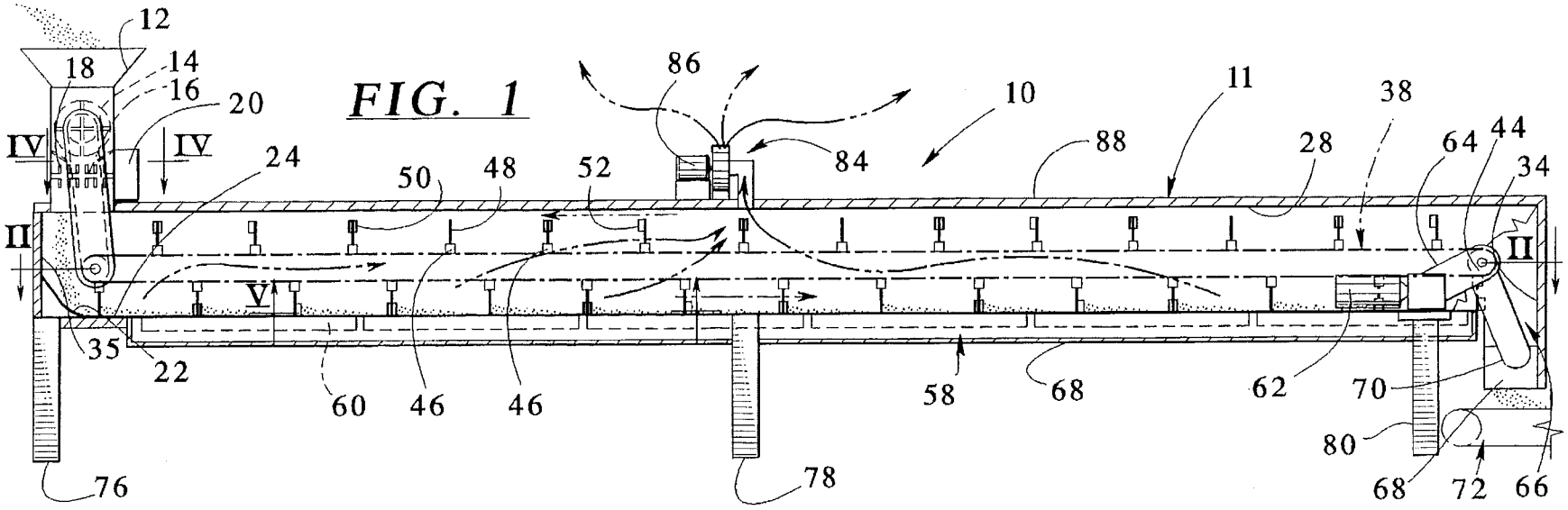
FIG. 1 is a longitudinal sectional view of the apparatus of the present invention.

FIG. 1 illustrates the sludge processing apparatus 10 of the present invention. The apparatus includes a housing 11 for drying and treating wet sludge. The housing 11 includes a wet sludge inlet funnel 12 which channels wet sludge into a rotating air lock valve 14. The air lock valve 14 allows passage of sludge but restricts pass through of air to a limited amount. Below the airlock valve 14 is a clod breaker 16 which has rotating bars 18 driven by a motor 20 to break up and pulverize clods present in the sludge. Once passing through the clod breaker 16, the sludge falls onto and over an arcuate deflector 22 to a bottom wall 24. The bottom wall 24 is a smooth surface.

The housing 11 includes a top wall 28, side walls 30, 32 and end walls 34, 35. Within the housing 11 resides a circulating conveyor 38, formed by two chains 40, 42 arranged in parallel and wrapped around a first set of sprockets 43 and a second set of sprockets 44. Arranged spaced apart and spanning between the chains 40, 42 are spaced, lateral rib plates 46. The rib plates 46 hold a variety of sludge scraper tools such as round rods 48, paddles 50, and plows 52. The scraper tools are arranged to closely pass along the smooth surface of the bottom wall 24 to manipulate sludge collected on the bottom wall 24 and slowly urge the sludge from the wall 22 toward the back wall 34.

Beneath the bottom wall 24 is located a heating compartment 58 having a plurality of heating elements 60 attached to an undersurface of the bottom wall 24 in order to heat the sludge through the bottom wall 24. The heating element 60 can be electric heat, gas heat or any other heating source. Alternately, the heating element can be infrared heat within the housing 11 or caused by the introduction of a warm air or gas into the housing 11 or the compartment 58.

The conveyor 38 is circulated such that the lower side of the conveyor circulates in the direction A as shown in FIG. 1 from left to right, and the upper side circulates from right to left in FIG. 1. The conveyor 38 is driven by a motor 62 connected via a drive chain or belt 64 to the sprockets 44. Adjacent the back wall 34 is a sludge outlet 66 having an air lock valve 68 rotated by a belt 70 and which permits the removal of dried sludge but restricts the entry of air therein. The sludge now in dried and powdered form can be removed via for example a conveyor belt 72 for further processing, loading, or other disposal. The apparatus is shown supported on legs 76, 78, 80. Centrally located on the top wall 28 is an air induced draft fan 84 powered by a motor 86 which draws air in limited quantity through the air locks 14, 68, through the housing 11 and out of the apparatus 10. This allows the removal of moisture laden air from the housing 11 to dry the heated wet sludge.

Figure 2:
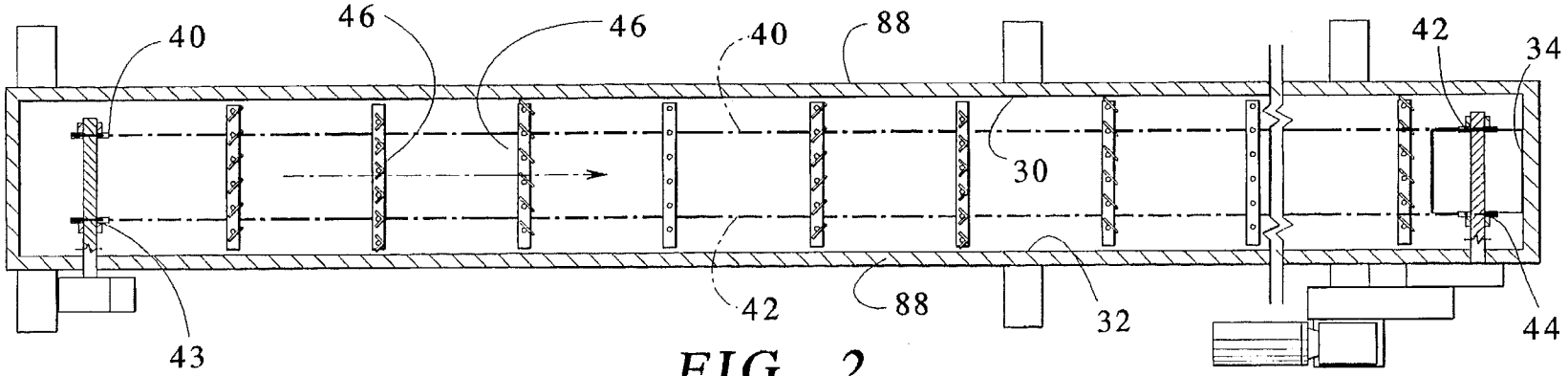
FIG. 2 is a sectional view of the apparatus in FIG. 1 taken generally along line II—II of FIG. 1.
Figure 3:
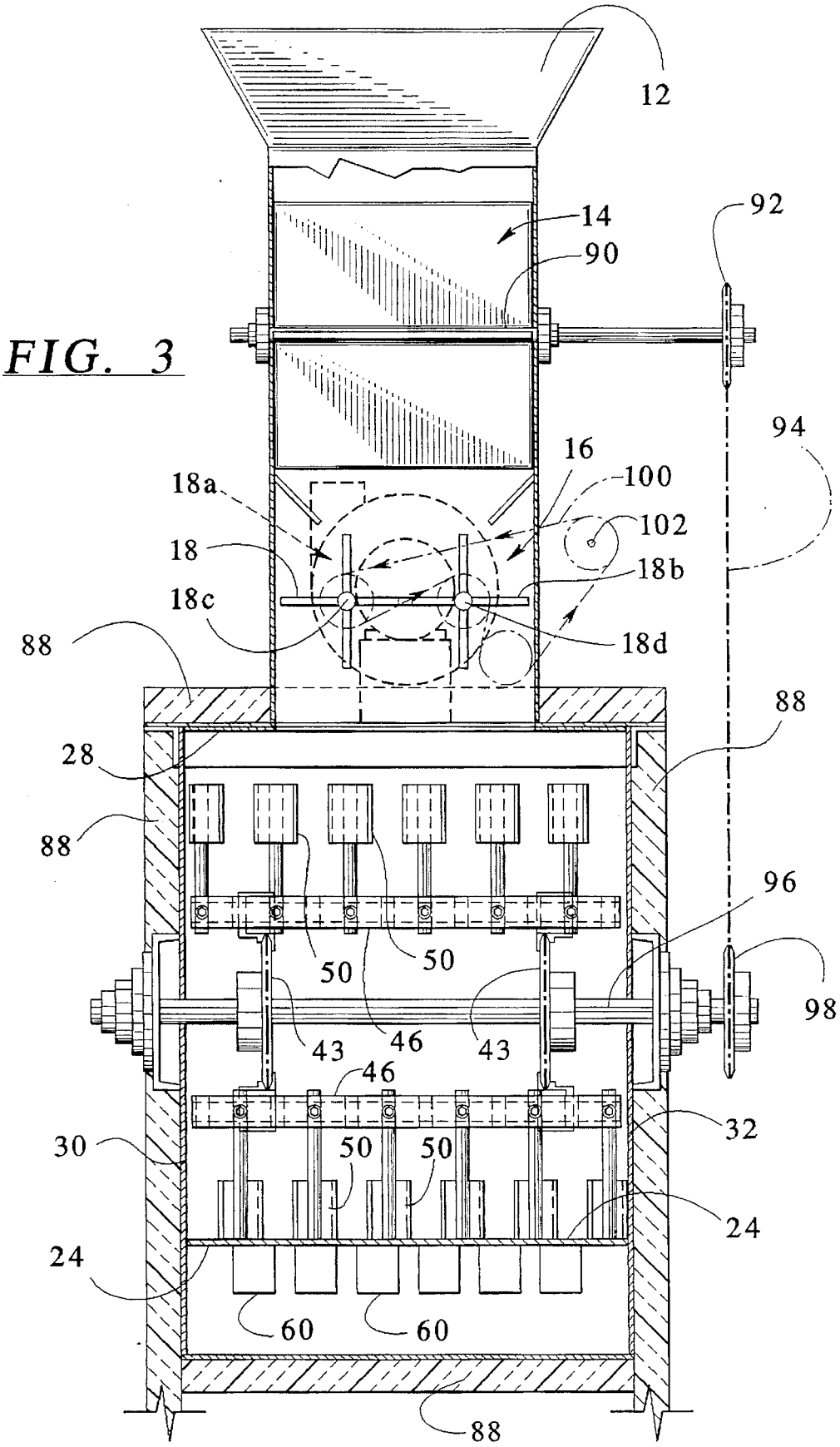
FIG. 3 is a left side view of the apparatus of FIG. 1 with end panels removed for clarity.

As shown in FIGS. 1–3, the housing 11 is insulated on the walls 30, 32, 34, 35 and above the top wall 28 and below the compartment 58 to enclose the housing 11 with insulation 88 to conserve energy.

FIG. 3 illustrates the air lock valve 14 being rotatable on a axle 90 which is driven by a sprocket 92 driven by a chain 94 from the sprocket pair 43 via a shaft extension 96 and secondary sprocket 98. The clod breaker 16 is shown having two groups of rods 18, first rod cluster **18*a* and second rod cluster 18*b* rotatable about shafts 18*c*, 18*d* respectively and spaced apart such that the rods intermesh. The shafts are rotated by a belt 100 driven by a motor 102** shown in phantom to rotate in opposite directions as shown. The intermeshing bars act to break up the clods to pass sludge therebetween.

Also shown in this figure are the heating elements 60 (six shown) which are in close proximity to the bottom wall 24 and which heat sludge held on the bottom floor 24 to dry it and also to kill pathogen and as applicable remove contaminants and undesirables.

Figure 5:
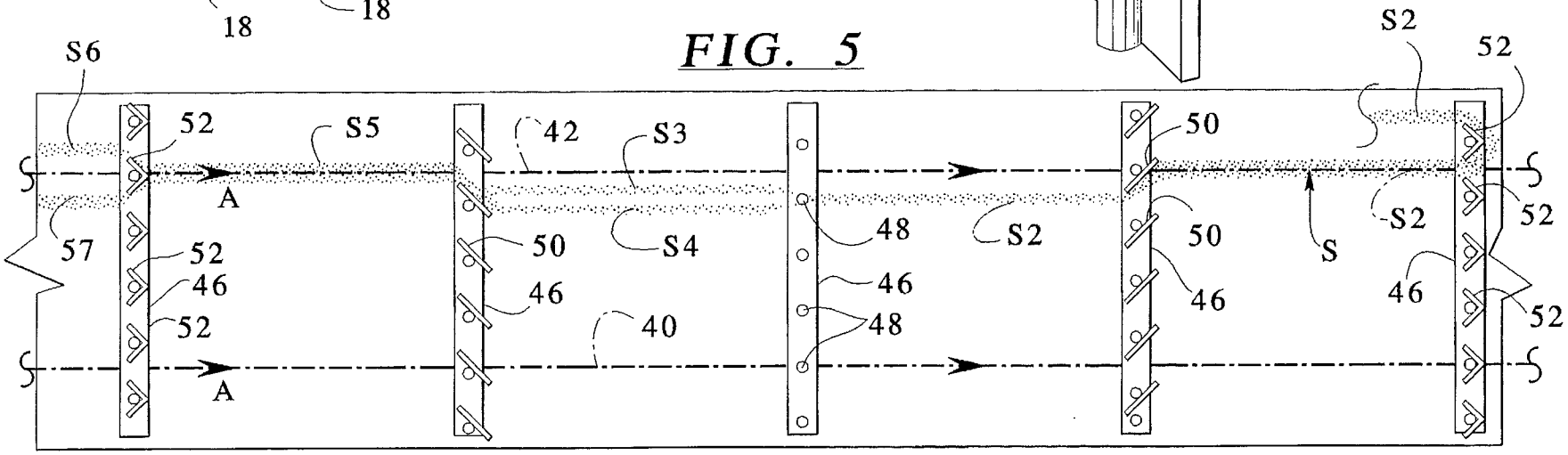
FIG. 5 is a sectional view taken generally along line V—V of FIG. 1.

FIG. 5 shows a portion of a bottom view of the apparatus just above the floor 24. One stream S of sludge is shown for simplicity although many parallel streams would be present across the width of the floor 24. The chains 40, 42 are moving in the direction A and dragging the attached lateral ribs 46 with them. Attached to the ribs 46 are the rods 48, the paddles 50 and the plows 52. As shown in the figure from right to left the stream S moving slowly from left to right is divided into streams S1, S2 by the plow 52. For simplicity only, the stream S1 is shown briefly and discontinued. The stream S2 is next deflected by the inclined paddles 50 to one side. Next, a bar 48 cuts the stream S2 into streams S3, S4 which can be recombined and deflected by oppositely inclined paddles 50 into a stream S5. The stream S5 is then split by an approaching plow 52 into the streams S6, S7. Depending on the sizing and position of the rods 48 and the sizing, positioning and angular orientation of the paddles 50 and the sizing and angulation of the plows 52, these streams can be deflected, combined, split and repeatedly deflected in a wide variety of sequences, for mixing and deflection of sludge to insure a continuous drying and heating throughout the sludge mass for processing.

By continuously mixing and redirecting the sludge, the sludge is heated evenly to avoid cold spots and a build up of sludge on the bottom wall is avoided.

Figure 6:
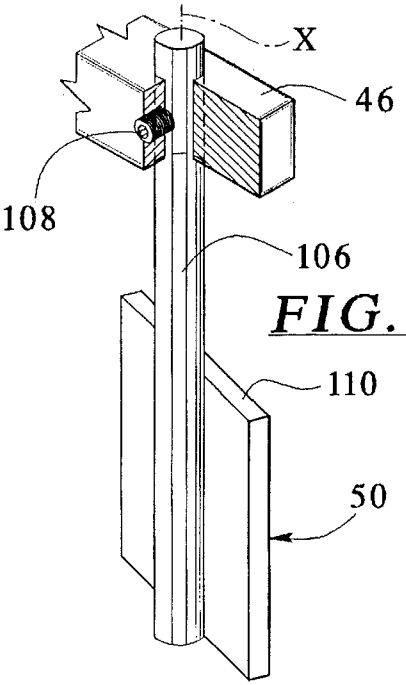
FIG. 6 is an enlarged perspective view, partially in section, of a portion of FIG. 1.
Figure 4:
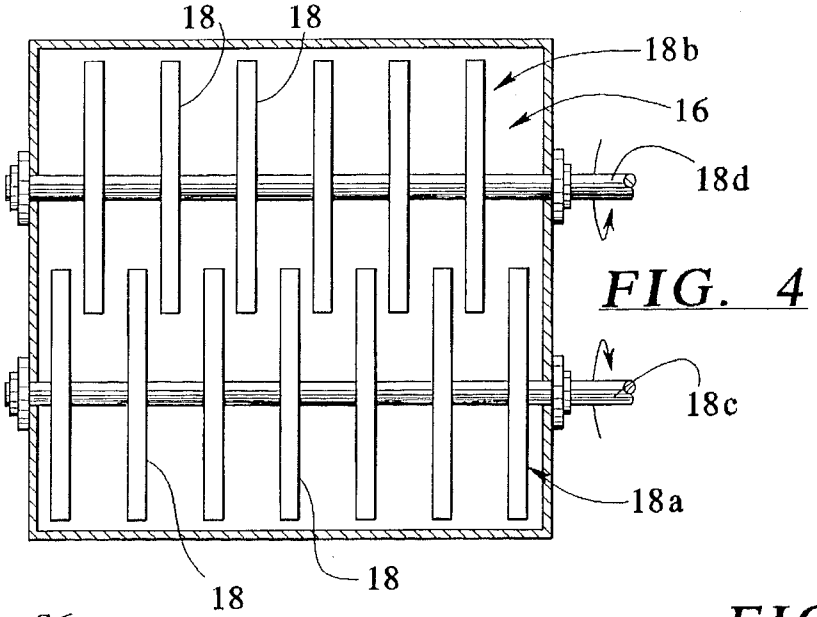
FIG. 4 is a sectional view taken generally along line IV—IV of FIG. 1.

FIG. 6 illustrates a constructional detail of a paddle 50 having a support shaft 106 locked into the rib 46 by a set screw 108. A paddle plate 110 is connected to the shaft 106. By loosening the set screw 108, the vertical positioning of the paddle plate 110 can be adjusted as well as its angular orientation about an axis X of the support shaft 106. The same fastening method is used for the rods 48 and the plows 52.

Because the chains 40, 42 have a degree of flexibility due to their span between sprockets 43, 44 if a solid object becomes wedged beneath a scraper tool or is immoveable, the scraper tool is deflected either upwardly or backwardly to pass the object.

The housing 11 may have two or more controlled heating zones. One of the zones heats the sludge to a temperature of 400° F. to kill all pathogens in the sludge. The conveyor can be set at a rate of 2–3 feet per minute while the sludge, moving more slowly by being dragged by the scraping tools, can have a total throughput of about 200–400 pounds per hour for a 35% solids content at the inlet to a substantially dry, powder-like consistency at the outlet.

Although the present invention has been described with reference to a specific embodiment, those of skill in the art will recognize that changes may be made thereto without departing from the scope and spirit of the invention as set forth in the appended claims.

I claim as my invention:

1. An apparatus for applying heat to a stream of solid material, comprising:

an elongate housing having an inlet opening at a first end and an outlet opening at a second end and a bottom surface holding said stream of solid material;

a means for heating said stream within said housing;

a conveyor mechanism located within said housing and extending between said first and second ends; and a plurality of scraper tools extending downwardly from said conveyor mechanism and slidable along the bottom surface of said housing, said scrapers arranged intermittently longitudinally along said conveyor mechanism and laterally offset proceeding in a moving direction of said conveyor for laterally redirecting said stream of said solid material and urging said solid material from said first end to said second end with movement of said conveyor mechanism.

2. The apparatus according to claim 1 wherein said plurality of scraper tools comprises paddles having a planar surface arranged at an oblique angle to the moving direction of the conveyor mechanism to laterally redirect a stream of sludge along said planar surface.

3. The apparatus according to claim 1 wherein said plurality of scraper tools comprises a plurality of round rods for splitting said stream of solid material into two sub-streams.

4. The apparatus according to claim 1 wherein said plurality of scraper tools comprises a plurality of V-shaped plows for splitting said stream of said solid material into two sub-streams.

5. The apparatus according to claim 1 wherein said means for heating comprises electrical heaters in contact with said bottom surface for conducting heat through said bottom surface and into said solid material held thereon.

6. The apparatus according to claim 1 further comprising a fan for removing moisture laden air from within said housing.

7. The apparatus according to claim 1 further comprising air lock valves at said inlet opening and said outlet opening.

8. The apparatus according to claim 1 wherein said plurality of scraper tools comprises a row of spaced apart V-shaped plows across a width of the conveyor mechanism;

a row of spaced apart round rods across a width of the conveyor.

9. The apparatus according to claim 8 further comprising a row of spaced apart tabular plate paddles spaced apart across a width of the conveyor mechanism and angled obliquely to the moving direction of the conveyor mechanism to laterally offset the stream of solid material.

10. The apparatus according to claim 1 wherein said conveyor mechanism comprises two spaced apart endless chains wrapped around two pairs of sprockets arranged respectively at said first and second ends of said housing, said sprockets rotated in a common rotatory direction to circulate said two chains in a parallel fashion; and spaced apart rib members spanning between said two chains and connected thereto, said rib members holding said plurality of scraper tools extending outwardly from said rib member.

* * * * *